US007784389B2

(12) United States Patent
Mardirossian

(10) Patent No.: US 7,784,389 B2
(45) Date of Patent: Aug. 31, 2010

(54) ANTI-TERRORIST SYSTEM

(75) Inventor: Aris Mardirossian, Germantown, MD (US)

(73) Assignee: Technology Patents, LLC, Derwood, MD (US)

( * ) Notice: Subject to any disclaimer, the term of this patent is extended or adjusted under 35 U.S.C. 154(b) by 661 days.

(21) Appl. No.: 11/378,636

(22) Filed: Mar. 20, 2006

(65) Prior Publication Data

US 2007/0214950 A1 Sep. 20, 2007

(51) Int. Cl.
*F41H 11/00* (2006.01)

(52) U.S. Cl. ..... 89/1.11; 89/1.1; 86/50; 340/825.72

(58) Field of Classification Search ..... 86/50, 86/1.1; 102/200, 201; 340/541, 825.72; 89/1.11, 1.1
See application file for complete search history.

(56) References Cited

U.S. PATENT DOCUMENTS 3,601,054 A * 8/1971 Christianson ..... 102/200
4,822,207 A 4/1989 Swahlan
4,884,506 A * 12/1989 Guerreri ..... 102/200
5,274,356 A * 12/1993 Taricco ..... 340/515
5,600,303 A * 2/1997 Husseiny et al. ..... 340/568.1
5,668,342 A * 9/1997 Discher ..... 86/50
6,232,519 B1 * 5/2001 Eidelman et al. ..... 588/320
6,354,181 B1 * 3/2002 Donovan ..... 86/50
6,587,790 B1 7/2003 Arnold
7,023,339 B2 * 4/2006 Stomski ..... 340/540
7,119,682 B1 * 10/2006 Fisher ..... 340/550
7,130,624 B1 * 10/2006 Jackson et al. ..... 455/420
7,270,227 B2 * 9/2007 Bender et al. ..... 198/358
7,296,503 B1 * 11/2007 McGrath ..... 89/1.13
7,536,170 B2 * 5/2009 Goldman et al. ..... 455/404.1
2002/0154012 A1 * 10/2002 Risi ..... 340/541
2002/0171735 A1 11/2002 Semones
2003/0069672 A1 4/2003 Rogitz
2004/0107027 A1 6/2004 Boudrieau
2005/0190061 A1 9/2005 Trela
2005/0235814 A1 * 10/2005 Diebold ..... 86/50
2007/0012168 A1 * 1/2007 Weatherwax ..... 89/36.04
2007/0232304 A1 * 10/2007 Goldman et al. ..... 455/435.1
2007/0234892 A1 * 10/2007 Goldman et al. ..... 89/1.13
2008/0134868 A1 * 6/2008 Goldman et al. ..... 89/1.13
2008/0134869 A1 * 6/2008 Goldman et al. ..... 89/1.13
2008/0134871 A1 * 6/2008 Goldman et al. ..... 89/1.13
2008/0134872 A1 * 6/2008 Goldman et al. ..... 89/1.13

OTHER PUBLICATIONS

Definition for "gateway" from www.bartleby.com.*
Definition for "confine" from www.bartleby.com.*

* cited by examiner

*Primary Examiner*—Benjamin P Lee
(74) *Attorney, Agent, or Firm*—Nixon & Vanderhye P.C.

(57) ABSTRACT

A system and/or method for securing areas (e.g. airport terminals, courtrooms, embassies, borders, property surrounding critical infrastructure, areas within cities/towns, etc.) against terrorists is provided. In certain example embodiments, a system and/or method is provided wherein individuals pass (e.g. walk, drive, etc.) through a gateway before gaining access to a secured area. Signals capable of detonating certain explosives that might be carried by the individuals passing through the gateway are emitted in or proximate the gateway. The gateway may be shielded to minimize damage to the surrounding areas. In certain example embodiments, arc currents are generated to trigger the detonation of explosives. In certain example embodiments, explosives may be detonated using cellular signals.

7 Claims, 5 Drawing Sheets

ANTI-TERRORIST SYSTEM

FIELD OF THE INVENTION

This invention relates to a system and/or method for securing areas (e.g. airport terminals, courtrooms, embassies, borders, property surrounding critical infrastructure, areas within cities/towns) from terrorists. In certain example embodiments of this invention, a system and/or method is provided wherein individuals pass (e.g. walk, drive, etc.) through a gateway before gaining access to a secured area. Signals capable of detonating certain explosives that might be carried by the individuals passing through the gateway are emitted by the gateway structure. Preferably, the gateway is mechanically shielded to minimize damage to surrounding areas and individuals should a detonation occur in the gateway.

BACKGROUND AND SUMMARY OF EXAMPLE EMBODIMENTS OF THE INVENTION

This country currently is waging a war against terrorism. Terrorism typically involves, for example, violent acts by an inherently weaker party against a stronger opponent. Terrorist tactics attempt to create fear through actual damage and unpredictability, the latter of which seemingly magnifies the impact of each successful attack. Defending against terrorist attacks frequently is not efficacious because, for example, members of the public tend to focus only on successful attacks while viewing money invested in other (e.g. untested or unnoticed) countermeasures as wasted. The public typically does not perceive the preventative measures taken by authorities unless they fail. Thus, the cost of a failure is readily discernable, whereas any increased deterrent effects are difficult to measure.

Modern-day terrorists, e.g., suicide/homicide bombers, threaten our forward-deployed missions and forces, as well as civilians, as indicated by the U.S. embassy bombings in Kenya and Tanzania in 1998, the U.S.S. Cole bombing in Yemen, and frequent attacks on U.S. and Iraqi forces in Iraq. And the events of Sep. 11, 2001 proved that suicide attacks are not confined to the Middle East.

The number of places that need to be protected against terrorists is large. Such places include traditional areas associated with checkpoints, such as, for example, airports, courts, seats of government (e.g. embassies, state legislatures, Congress, the White House, etc.), border-crossings (both inter- and intra-nationally), military bases, government installations, etc. Critical infrastructure (including, for example, water treatment and/or dispensation facilities, power plants, communications hubs, etc.) also needs to be protected. Amusement parks, stadiums, malls, subways, and other areas where people congregate also may be deemed necessary to secure in certain situations. Thus, areas within buildings, blocks in cities, and entire cities may need to be secured, particularly from suicide attacks, in certain instances.

Requiring people to pass through metal detectors at airports helps prevent some attacks by, for example, detecting guns and knives. However, metal detectors cannot always detect all weapons (e.g. plastic explosives, weapons that require some assembly, etc.). Moreover, by the time some weapons are detected, it may well be too late to take action and/or prevent carnage. For example, a terrorist may detonate an explosive as soon as it is detected. Indeed, an explosive may be detected while a terrorist is waiting in line to be screened. Such attacks were common at border-crossings between Israel-proper and the Disputed Territories (e.g. the Gaza Strip and the West Bank). These problems exist where checkpoints and metal detectors exist, and the problems are exacerbated where there are no such checkpoints. Bombs can be placed in concealed locations and detonated when innocent people come near them. For example, there are few, if any, trash-cans in the London Underground after the IRA purportedly continued to hide explosives therein. And, these days, cell phones even can detonate explosives remotely. Similar problems exist as individuals move in, through, and around other of the above-described areas.

Accordingly, these and other areas must be secured against threats of these and other kinds. Thus, it will be appreciated that there is a need for a system and/or method for securing areas. In certain example embodiments, a method of securing an area is provided. Certain example methods are comprised of permitting an individual or a group of individuals to enter into a gateway; emitting at least one signal in or proximate the gateway to detonate any explosives being transported by the individual or the group of individuals; and, when the at least one signal does not cause an explosion, allowing the individual or group of individuals to exit the gateway. In certain example embodiments, the signal may be one or more of an electrostatic discharge, electromagnetic waves, an electric arc, a voltaic arc, and/or at least one cellular signal.

In certain example embodiments, the individual or the group of individuals may be required to comply with at least one command of an official at a checkpoint. The command may be, for example, for the individual and/or the group of individuals to remove all metal, to turn off all electronic devices, and/or to wait. Certain example embodiments may also comprise sealing an entry door and/or an exit door after the individual or the group of individuals has entered the gateway; and, opening the entry door and/or the exit door after the at least one signal has been emitted.

In certain example embodiments, it is possible to limit only one individual or one group of individuals to enter into the gateway at a time. In some example embodiments, the individual and/or group of individuals walk into the gateway, whereas in certain example embodiments the individual and/or group of individual enter the gateway via an automobile.

Certain exemplary systems for securing an area are also provided. They may be comprised of a gateway through which an individual or a group of individuals must pass; and, a detonator capable of emitting signal(s) to detonate explosives that the individual or the group of individuals may be carrying. Preferably, the gateway is mechanically fortified so as to minimize damage from the potential explosion and/or debris from the explosion.

In certain example embodiments, the gateway may be a tunnel enclosed in and/or constructed from a blast resilient material, and in certain example embodiments, the blast resilient material is comprised of steel and/or a resilient polymer. Certain example embodiments further comprise an entry door and/or an exit door, and in certain example embodiments, the entry door and/or the exit door is comprised of a blast resilient material.

In certain example embodiments of this invention, there is provided a system for securing an area, comprising: a gateway through which an individual or a group of individuals must pass; and, a detonator capable of emitting at least one detonation signal in or proximate the gateway, the detonation signal being sufficient to detonate explosives that the individual or the group of individuals may be carrying; and wherein the gateway is mechanically fortified so as to minimize damage from the explosion and/or debris from the explosion.

BRIEF DESCRIPTION OF THE DRAWINGS

These and other features and advantages will be better and more completely understood by reference to the following detailed description of exemplary illustrative embodiments in conjunction with the drawings, of which.

DETAILED DESCRIPTION OF EXAMPLE EMBODIMENTS OF THE INVENTION OF THE INVENTION

Figure 1:
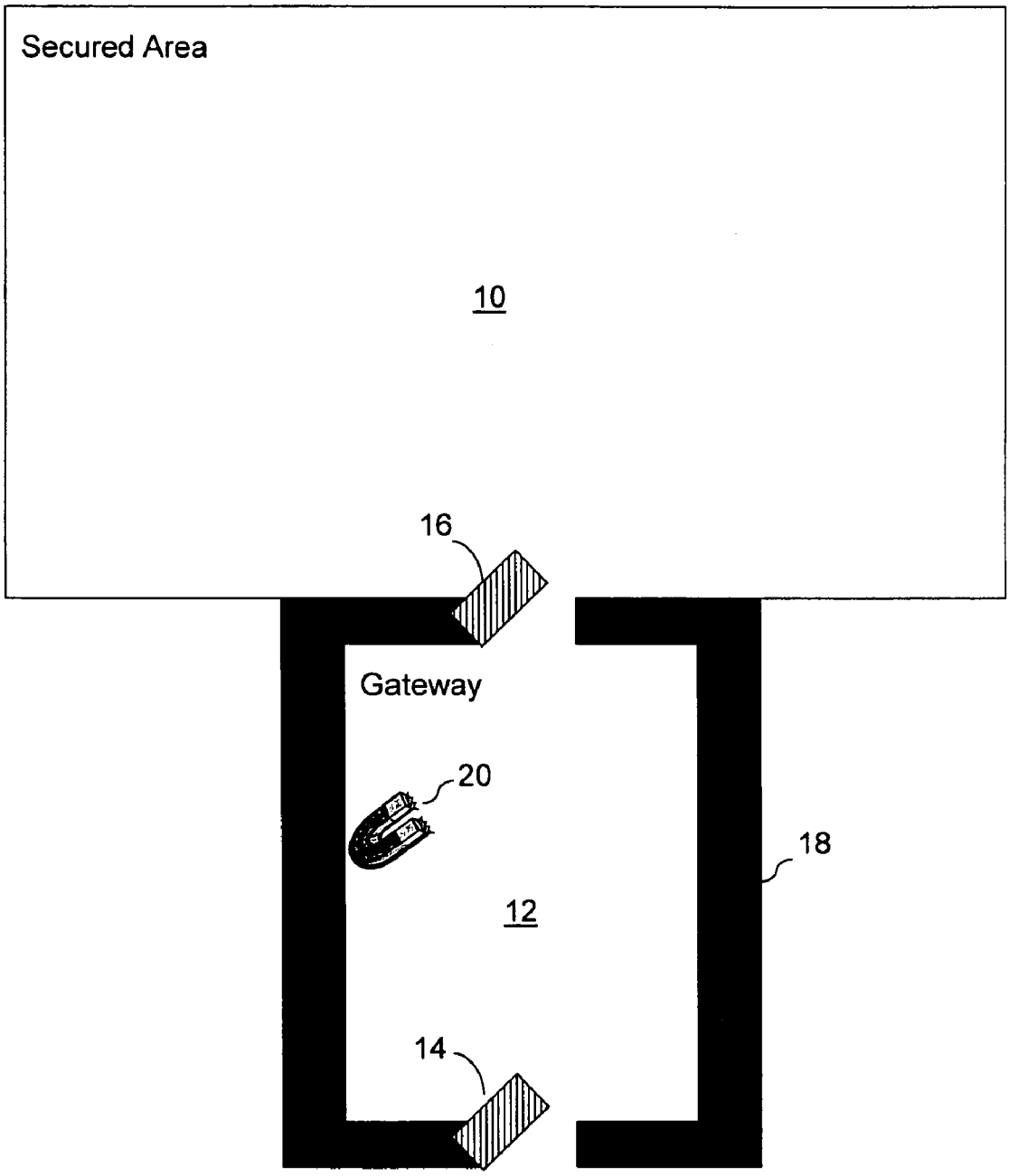
FIG. 1 is a partial layout view of one example embodiment, showing a secured area and a gateway.

Referring now to the drawings, FIG. 1 is a partial layout view of one example embodiment, showing a secured area 10 and a gateway 12. It will be appreciated that secured area 10 need not have precise boundaries. By way of example and without limitation, a courtroom, airport, government building, supermarket, or the like may be a secured area with boundaries, while a stadium or a group of embassies may qualify as secured areas without having specific boundaries. An area 10 may be secured for any number of reasons. For example, airports, courts, seats of government (e.g. embassies, state legislatures, Congress, the White House, etc.), border-crossings (both inter- and intra-nationally), military bases, government installations, etc. may be secured. Critical infrastructure (including, for example, water dispensation and/or treatment facilities, power plants, communications hubs, etc.) also may exist within secured areas 10. Areas where people congregate (e.g. amusement parks, stadiums, malls, subways, and the like) also may exist within a secured area 10. It will be appreciated that an entire city block, or a number of city blocks may be secured (e.g. all of Capitol Hill, comprising, for example, Congress, the House and Senate Office Buildings, etc.) as a secured area 10.

Only one gateway 12 is shown in FIG. 1, though it will be appreciated that multiple such gateways 12 may allow entrance to and/or exit from a secured area 10. In certain example embodiments, a gateway 12 will be present at each entry and/or exit point from a secured location 10. It also will be appreciated that in certain example embodiments, one gateway 12 (or a first set of gateways) may be used only for entrance to the secured area, while another optional gateway 12 (or a second set of gateways) may be used only for exit from the secured area.

A gateway 12 may have points of entrance/exit 14 and 16. In FIG. 1, points of entrance/exit 14 and 16 are shown as panels or doors that may open and close. In certain example embodiments, it is advantageous to close points of entrance/exit 14 and 16, for example, to prevent individuals from accidentally wandering into or out of gateway 12, to contain an explosion and/or debris therefrom, to prevent individuals from racing through gateway 12 before the screening process can be completed, etc. However, in some example embodiments, such panels may not be necessary because, for example, the length of gateway 12 is sizable enough to prevent a blast, or debris resulting therefrom, from substantially escaping the body of the gateway 12.

A gateway 12 may be bounded by gateway walls 18. In certain example instances, gateway walls 18, as well as points of entrance/exit 14 and 16, are comprised of a material capable of withstanding enormous pressure from explosions, heat, flying debris, etc. Gateway walls 18 may be constructed, in part, from steel, a highly resilient plastic or polymer, etc. The exact pressure, heat, etc. a particular structure can withstand will depend, in part, on the type of material from which it is constructed. Thus, one should exercise care when evaluating the risk and designing a gateway structure, for example, weighing the costs and benefits of certain designs and improvements on such designs.

In certain example embodiments, gateway walls 18 may be "reinforced" by the very lay of the land. For example, if there is only one route into or out of a city, a gateway may exist well outside of the city, for example, in farm country. In this case, individuals with explosives passing through a gateway well outside the city limits may be stopped without too much worry regarding the effects of the surrounding territories. Thus, in certain example embodiments, gateway 12 need not have any boundary wall at all, provided that the topography of the land and the location of the gateway allows for such a configuration. Moreover, in certain example embodiments, gateway 12 may be a tunnel, partially or completely underground, and in certain example embodiments, gateway 12 may or may not have a roof (fortified or unfortified) covering the area.

FIG. 1 also shows a detonator 20. Although detonator 20 is shown within gateway 12, it will be appreciated that it may be located anywhere (e.g. outside or underneath of gateway 12, etc.), so long as it can it can generate the signals that can be used to detonate explosives within gateway 12. In certain example embodiments, detonator 12 will be shielded to prevent damage to it if something (e.g., a bomb being carried by a terrorist) is detonated within gateway 12. Several example non-limiting ways detonator 20 may function will be described below.

Optionally, manned checkpoints may be present outside of gateway 12 at least on the incoming side thereof. It will be appreciated that any of such manned checkpoints should be shielded from any blast that might occur within gateway 12. Such gateways or checkpoints may be used, for example, to prevent multiple individuals from entering gateway 12 at once, to isolate exposure to detonator 12, to make sure individuals turn off electronic devices and/or leave electronic devices outside of gateway 12 for collection later, etc.

It also will be appreciated that gateway 12 may allow individuals to walk, drive, etc. through it and into secured area 10. Accordingly, gateway 12 may, depending upon the example embodiment implemented, detonate one or more of a personal explosive (e.g. an explosive vest), plastique explosives, fertilizer-type explosives (e.g. similar to those used in the Oklahoma City Bombings), etc.

Figure 2:
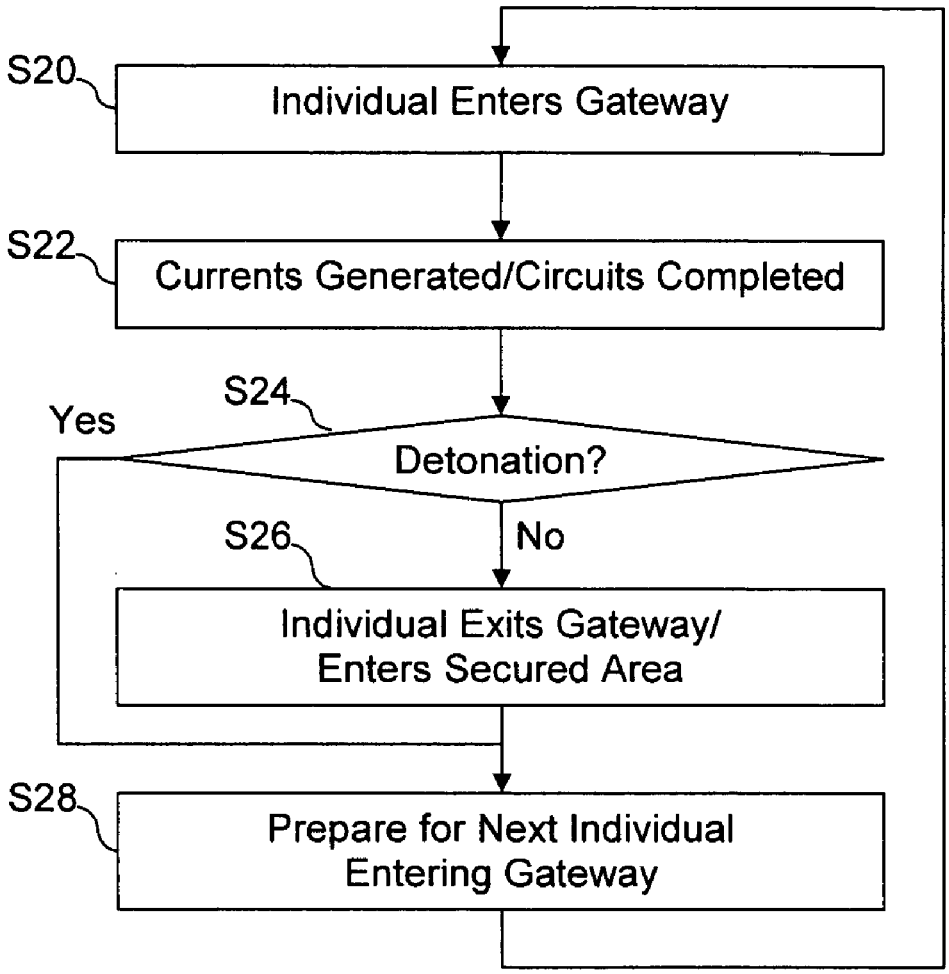
FIG. 2 is an illustrative flowchart in accordance with one example embodiment.

FIG. 2 is an illustrative flowchart in accordance with one example embodiment. In an optional step not shown in FIG. 2, before an individual enters the gateway, individuals may have to comply with certain requirements made by, for example, officials at a checkpoint. Such requirements may include, for example, removing all metal objects from a person, turning off and/or temporarily handing-over all electronic devices, etc.

In step S20 of FIG. 2, an individual enters the gateway 12. It will be appreciated that the individual may be traveling by foot, car, bike, etc., and that the individual may or may not be aware that the individual is entering a gateway 12 according to this example embodiment. In certain example embodiments, individuals clearly will know that they are entering a gateway 12 because the gateway may be a conspicuous structure (e.g. a protective tunnel). Preferably, one individual or one vehicle will enter a gateway at a time, for example, to prevent collateral damage.

In step 22, currents are generated in or proximate the gateway 12 to complete circuits. This step is designed to, for example, remotely detonate explosives, independent of the individual passing through the gateway, with minimal harm to others, etc. To protect against cell phone detonated bombs, step 22 also may initiate a range of cellular band broadcasts. It will be appreciated that other techniques for detonating explosives may be used in combination with, or in place of, those described herein.

Step 24 determines whether step 22 resulted in a detonation. If there is no detonation, in step S26, an individual exits the gateway and enters a secured area 10. It will be appreciated that in certain example embodiments, individuals may enter into a non-secured area after passing through the gateway. Although not shown in FIG. 2, individuals may pickup any items they had to deposit in the optional step described above if there is no explosion. After preparing the gateway for the next individual to enter the gateway in step S28, the system returns to step S20 so that the process can repeat. The preparing step may require, for example, closed blast doors to be reopened, any lingering charged particles to be evacuated from the gateway chamber, etc.

If, however, a detonation occurs in step S24, the preparing step S28 may be more complicated. For example, if there is an explosion, debris will need to be cleaned up. Additionally, reports may be generated to catalog information about the explosion, such as, for example, the date and/or time of the explosion, the frequency that caused the explosion, the size of the blast, the type of explosive that was detonated, any information about the individual(s) passing through the gateway, etc. Such reports may be analyzed later, for example, to provide information on terrorist tracking, to adduce larger plots and/or schemes, etc.

Figure 3:
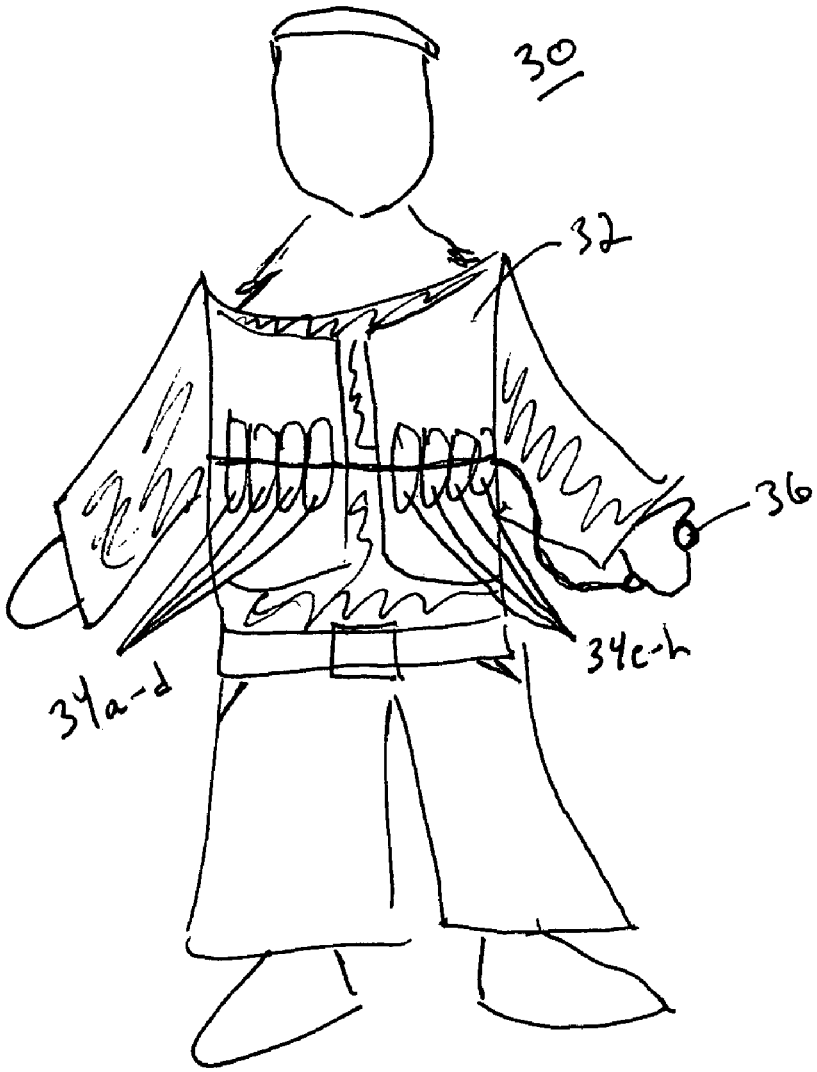
FIG. 3 is a stylized view of a hypothetical terrorist, armed with an explosive device and detonator.

FIG. 3 is a stylized view of a hypothetical terrorist, armed with an explosive device and detonator. Terrorist 30 is shown having a low-technology explosive vest 32. Attached to vest 32 are explosives 34*a-h*. Terrorist 30 detonates explosives 34*a-h* via a handheld detonator 36. In essence, handheld detonator 36 completes a circuit which triggers the explosion of explosives 34*a-h*. Thus, detonator 20 shown in FIG. 1 attempts to complete the circuit controlling the detonation of explosives 34*a-h* in FIG. 3. Of course, it will be appreciated that other, more complicated explosives may be employed by terrorists. However, the idea behind explosives in general essentially is the same—explosives will not detonate until some kind of controlling signal is given.

For the purposes of these examples, explosives' detonators are assumed to be electrostatic discharge sensitive (ESDS) devices. Accordingly, one way a circuit controlling the detonation of explosions can be completed is by causing an electrostatic charge to hit the device. A number of models of electrostatic testing devices are well known, and any could be substituted, modified, or used in combination with this invention. It will be appreciated that the exact voltages, ohms, etc. used may be modified depending on, for example, the situation, safety concerns, etc.

Figure 4A:
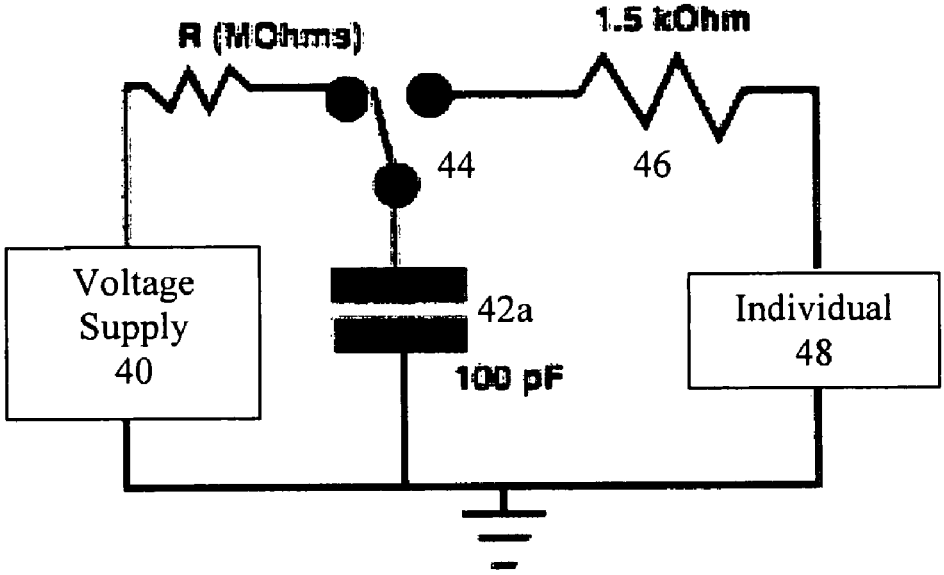
FIG. 4A is an example Human Body Model circuit that can be used to detonate explosives; and, FIG. 4B is an example Machine Model circuit that can be used to detonate explosives.

The Human Body Model (HBM) is the oldest and most commonly used model for classifying device sensitivity to electrostatic discharge (ESD). This is of course used for example non-limiting purposes. FIG. 4A is an example Human Body Model circuit that can be used to detonate explosives. Conventionally, the HBM testing model represents the discharge from the fingertip of a standing individual delivered to a potentially ESDS device. It is modeled by elements including, for example, a voltage supply 40, and a 100 pF capacitor 42*a* discharged through a switching component 44 and a 1.5 kOhm series resistor 46 into the component. In certain example embodiments, individual 48 comes into contact with the surface, by for example, contacting a relay matrix (not shown). ESD zaps are applied. Variables, such as, for example, the number of zaps, the frequency of zaps, etc. may be changed based on the implementation chosen. At least one ESD zap preferably causes an explosion if an individual 48 is concealing explosives, while such zaps preferably are harmless to those not carrying explosives. One of the most widely used models is defined in the JEDEC 22-A114-B standard, which specifies a 100 picofarad capacitor and a 1,500 ohm resistor. Other similar standards are MIL-STD-883 Method 3015, and the ESD Association's ESD STM5.1.

Figure 4B:
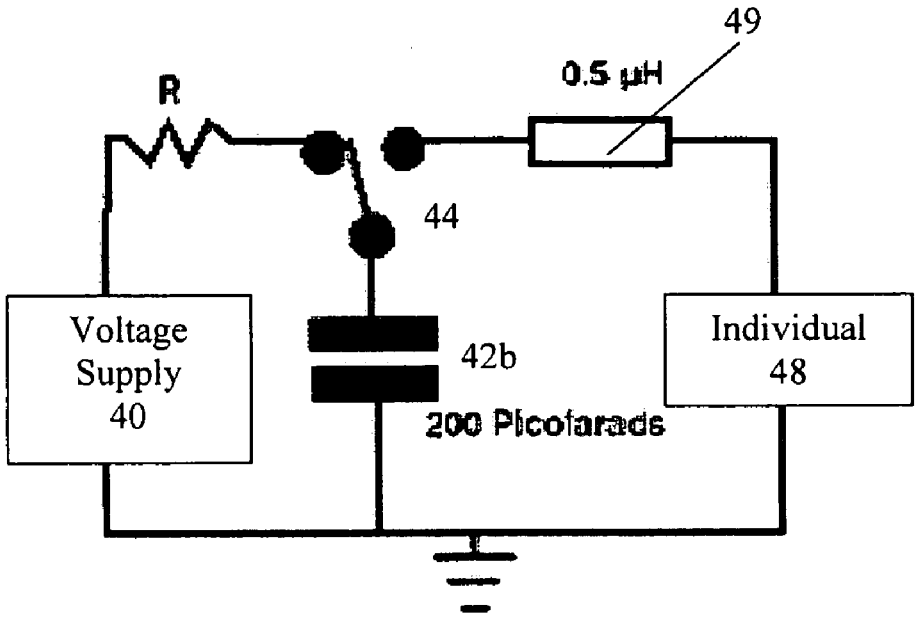

FIG. 4B is an example Machine Model (MM) circuit that can be used to detonate explosives. This ESD model is comprised of a 200 pF capacitor 42*b* discharged directly into a component with no series resistor. The MM version does not have a 1,500 ohm resistor, but otherwise the test board and the socket are the same as for HBM testing. The series inductance is the dominating parasitic element 49 that shapes the oscillating machine model wave form. The series inductance may be indirectly defined through the specification of various waveform parameters.

When a circuit of an explosive device being carried by a terrorist in a gateway 12 is completed by any of the circuit completing techniques discussed herein, the explosive detonates thereby destroying the explosive and killing the terrorist (s).

In certain example embodiments, circuits may be completed by using electric arcs and/or voltaic arcs. Briefly, two elements (e.g. two electrodes) are brought into proximity with each other (e.g., on opposite sides of the gateway 12). Then, the currents are arced (e.g. by slowly moving the two elements away from each other). Preferably, this method closes any open circuits and thus detonates any explosives in the gateway 12. Currents also may be arced in certain example embodiments comprised of large magnets. In certain example embodiments, a gas may be introduced into the gateway 12 to better facilitate the creation and travel of currents through air. Care must be taken, as arcs can result in very high temperatures. Thus, in certain preferred embodiments (similar to those used for lighting), low-pressure arcs are used to complete an explosive circuit in the gateway 12 thereby detonating the explosive in the gateway.

A detonator 20 as in FIG. 2 also may include circuitry capable of producing cell phone signals. Briefly, such circuitry emits cell phone band signals to detonate, for example, cell phone triggered explosives. It will be appreciated that other forms of detonating devices may be used in place of, and/or together with, those described herein.

In certain example embodiments of this invention, the exit door out of the gateway will not open until (a) the entrance door to the gateway has been closed, and (b) a predetermined period of time X has elapsed following closing of the entrance door that is selected to permit the detonation signal to be applied to person(s) in the gateway. In certain example embodiments, the predetermined period of time X is from about 1-15 seconds, more preferably from about 2-10 seconds. In other example embodiments of this invention, the entrance door to the gateway sill not open until (a) the exit door out of the gateway has been closed, and (b) a predetermined period of time X has elapsed following closing of the exit door. Again, time X may be from about 1-15 seconds, more preferably from about 2-10 seconds.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of securing a fixed confined area, said method comprising:

instructing or permitting at least one person to enter a gateway adjacent to the fixed confined area;

sealing an entry door and/or an exit door after the at least one person has entered the gateway via an automobile;

emitting at least one detonation signal in or proximate to the gateway to detonate any explosive the person is attempting to transport through the gateway and into the fixed confined area;

opening the entry door and/or the exit door a predetermined amount of time after the at least one signal has been emitted; and, when the at least one detonation signal does not cause an explosion, wherein the gateway is surrounded by armored walls capable of withstanding an explosion, such walls being arranged to reduce both an amount of debris and an impact of a blast resulting from the explosion from escaping the gateway, and wherein the at least one detonation signal is emitted from a shielded detonator located in or proximate to the gateway.

2. The method of claim 1, wherein the at least one detonation signal is one or more of an electrostatic discharge signal, an electric arc signal, and/or a voltaic arc signal.

3. The method of claim 1, further comprising causing the person to comply with at least one command of an official at a checkpoint when entering the gateway.

4. The method of claim 3, wherein the at least one command is for the person to remove all metal and/or to turn off all electronic devices before entering the gateway.

5. The method of claim 1, wherein only one person or group of persons enters the gateway at a time.

6. A method of securing a fixed confined area, said method comprising:

instructing or permitting at least one person to enter a gateway adjacent to the fixed confined area via an automobile;

emitting at least one detonation signal in or proximate to the gateway to detonate any explosive the person is attempting to transport through the gateway and into the fixed confined area; and, when the at least one detonation signal does not cause an explosion, allowing the at least one person to exit the gateway, wherein the gateway is surrounded by armored walls capable of withstanding an explosion, such walls being arranged to reduce both an amount of debris and an impact of a blast resulting from the explosion from escaping the gateway, and wherein the at least one detonation signal is emitted from a shielded detonator located in or proximate to the gateway, wherein the gateway is provided with an entrance door and an exit door, and wherein the exit door out of the gateway will not open until (a) the entrance door to the gateway has been closed, and (b) a predetermined period of time X has elapsed following closing of the entrance door.

7. The method of claim 6, wherein the predetermined period of time X is from about 2-10 seconds.

* * * * *